US009709285B2

(12) United States Patent
Vandermeulen

(10) Patent No.: US 9,709,285 B2
(45) Date of Patent: Jul. 18, 2017

(54) METHODS AND SYSTEMS FOR LIQUID DESICCANT AIR CONDITIONING SYSTEM RETROFIT

(71) Applicant: 7AC Technologies, Inc., Beverly, MA (US)

(72) Inventor: Peter F. Vandermeulen, Newburyport, MA (US)

(73) Assignee: 7AC Technologies, Inc., Beverly, MA (US)

( * ) Notice: Subject to any disclaimer, the term of this patent is extended or adjusted under 35 U.S.C. 154(b) by 299 days.

(21) Appl. No.: 14/212,263

(22) Filed: Mar. 14, 2014

(65) Prior Publication Data

US 2014/0260371 A1 Sep. 18, 2014

Related U.S. Application Data

(60) Provisional application No. 61/782,579, filed on Mar. 14, 2013.

(51) Int. Cl.
*F24F 3/14* (2006.01)

(52) U.S. Cl.
CPC .... *F24F 3/1417* (2013.01); *F24F 2003/1458* (2013.01); *F24F 2221/16* (2013.01)

(58) Field of Classification Search
CPC ..... F24F 3/1411; F24F 3/1417; F24F 2003/1458; F24F 2221/16; E04D 13/17
See application file for complete search history.

(56) References Cited

U.S. PATENT DOCUMENTS

| | | | |
|---|---|---|---|
| 1,791,086 | A | 2/1931 | Sperr |
| 2,221,787 | A | 11/1940 | Downs et al. |
| 2,235,322 | A | 3/1941 | Martin |
| 2,433,741 | A | 12/1947 | Crawford |
| 2,988,171 | A | 6/1961 | Arnold et al. |
| 3,718,181 | A | 2/1973 | Reilly et al. |
| 4,100,331 | A | 7/1978 | Fletcher et al. |
| 4,176,523 | A | 12/1979 | Rousseau |
| 4,205,529 | A | 6/1980 | Ko |
| 4,209,368 | A | 6/1980 | Coker et al. |
| 4,222,244 | A | 9/1980 | Meckler |
| 4,235,221 | A | 11/1980 | Murphy |

(Continued)

FOREIGN PATENT DOCUMENTS

| | | | |
|---|---|---|---|
| CN | 202229469 | U | 5/2012 |
| EP | 1120609 | A1 | 8/2001 |

(Continued)

OTHER PUBLICATIONS

1—Open Absorption System for Cooling and Air Conditioning using Membrane Contactors—Annual Report 2005, Publication No. Publication 260097, Project: 101310—Open Absorption System for Cooling and Air Conditioning using Membrane Contactors, Date of publication: Jan. 31, 2006, Author: Manuel Conde-Petit, Robert Weber, Contractor: M. Conde Engineering.

(Continued)

*Primary Examiner* — Christopher R Zerphey
(74) *Attorney, Agent, or Firm* — Foley Hong LLP; Rajesh Vallabh

(57) ABSTRACT

Methods and systems are disclosed for utilizing liquid desiccant air conditioning systems in connection with existing HVAC equipment to achieve reductions in electricity consumption.

18 Claims, 12 Drawing Sheets

(56) References Cited

U.S. PATENT DOCUMENTS 4,239,507 A 12/1980 Benoit et al.
4,259,849 A 4/1981 Griffiths
4,324,947 A 4/1982 Dumbeck
4,399,862 A * 8/1983 Hile ..... F24F 11/0009 165/253
4,429,545 A 2/1984 Steinberg
4,435,339 A 3/1984 Kragh
4,444,992 A 4/1984 Cox, III
4,583,996 A 4/1986 Sakata et al.
4,607,132 A 8/1986 Jarnagin
4,612,019 A 9/1986 Langhorst
4,649,899 A 3/1987 Moore
4,691,530 A 9/1987 Meckler
4,703,629 A 11/1987 Moore
4,766,952 A 8/1988 Onodera
4,786,301 A 11/1988 Rhodes
4,832,115 A 5/1989 Albers et al.
4,872,578 A 10/1989 Fuerschbach et al.
4,882,907 A 11/1989 Brown, II
4,887,438 A 12/1989 Meckler
4,900,448 A 2/1990 Bonne et al.
4,910,971 A 3/1990 McNab
4,939,906 A 7/1990 Spatz et al.
4,941,324 A 7/1990 Peterson et al.
4,955,205 A 9/1990 Wilkinson
4,976,313 A 12/1990 Dahlgren et al.
4,979,965 A 12/1990 Sannholm
4,984,434 A 1/1991 Peterson et al.
4,987,750 A 1/1991 Meckler
5,005,371 A 4/1991 Yonezawa et al.
5,181,387 A 1/1993 Meckler
5,182,921 A 2/1993 Yan
5,186,903 A 2/1993 Cornwell
5,191,771 A * 3/1993 Meckler ..... B01D 53/261 62/271
5,221,520 A 6/1993 Cornwell
5,351,497 A 10/1994 Lowenstein
5,375,429 A 12/1994 Tokizaki et al.
5,462,113 A 10/1995 Wand
5,471,852 A 12/1995 Meckler
5,528,905 A 6/1996 Scarlatti
5,534,186 A 7/1996 Walker et al.
5,582,026 A * 12/1996 Barto, Sr. ..... F24F 1/0003 62/298
5,595,690 A 1/1997 Filburn et al.
5,605,628 A 2/1997 Davidson et al.
5,638,900 A 6/1997 Lowenstein et al.
5,641,337 A 6/1997 Arrowsmith et al.
5,661,983 A 9/1997 Groten et al.
5,685,152 A 11/1997 Sterling
5,685,485 A 11/1997 Mock et al.
5,797,272 A 8/1998 James
5,832,993 A 11/1998 Ohata et al.
5,860,284 A 1/1999 Goland et al.
5,860,285 A 1/1999 Tulpule
5,928,808 A 7/1999 Eshraghi
5,933,702 A 8/1999 Goswami
6,018,954 A 2/2000 Assaf
6,083,387 A 7/2000 LeBlanc et al.
6,103,969 A 8/2000 Bussey
6,156,102 A 12/2000 Conrad et al.
6,171,374 B1 1/2001 Barton et al.
6,216,483 B1 4/2001 Potnis et al.
6,244,062 B1 6/2001 Prado
6,247,604 B1 6/2001 Taskis et al.
6,266,975 B1 7/2001 Assaf
6,417,423 B1 7/2002 Koper et al.
6,442,951 B1 9/2002 Maeda et al.
6,463,750 B2 10/2002 Assaf
6,487,872 B1 12/2002 Forkosh et al.
6,488,900 B1 12/2002 Call et al.
6,497,107 B2 12/2002 Maisotsenko et al.
6,497,749 B2 12/2002 Kesten et al.
6,502,807 B1 1/2003 Assaf et al.
6,514,321 B1 2/2003 Lehto et al.
6,539,731 B2 4/2003 Kesten et al.
6,546,746 B2 4/2003 Forkosh et al.
6,557,365 B2 5/2003 Dinnage et al.
6,660,069 B2 12/2003 Sato et al.
6,684,649 B1 2/2004 Thompson
6,739,142 B2 5/2004 Korin
6,745,826 B2 6/2004 Lowenstein et al.
6,766,817 B2 7/2004 da Silva
6,854,278 B2 2/2005 Maisotsenko et al.
6,854,279 B1 2/2005 Digiovanni et al.
6,918,404 B2 7/2005 Dias da Silva et al.
6,938,434 B1 9/2005 Fair
6,976,365 B2 12/2005 Forkosh et al.
6,986,428 B2 1/2006 Hester et al.
7,066,586 B2 6/2006 da Silva et al.
RE39,288 E 9/2006 Assaf
7,143,597 B2 12/2006 Hyland et al.
7,191,821 B2 3/2007 Gronwall et al.
7,197,887 B2 4/2007 Maisotsenko et al.
7,269,966 B2 9/2007 Lowenstein et al.
7,279,215 B2 10/2007 Hester et al.
7,306,650 B2 12/2007 Slayzak et al.
7,337,615 B2 3/2008 Reidy
7,430,878 B2 10/2008 Assaf
7,758,671 B2 7/2010 Kesten et al.
7,938,888 B2 5/2011 Assaf
8,337,590 B2 12/2012 Herencia et al.
8,353,175 B2 1/2013 Wohlert
8,496,732 B2 7/2013 Culp et al.
8,500,960 B2 8/2013 Ehrenberg et al.
8,623,210 B2 1/2014 Manabe et al.
8,641,806 B2 2/2014 Claridge et al.
8,648,209 B1 2/2014 Lastella
8,695,363 B2 4/2014 Tang et al.
8,696,805 B2 4/2014 Chang et al.
8,769,971 B2 7/2014 Kozubal et al.
8,790,454 B2 7/2014 Lee et al.
8,800,308 B2 8/2014 Vandermeulen et al.
8,876,943 B2 11/2014 Gottlieb et al.
8,881,806 B2 11/2014 Xie et al.
8,968,945 B2 3/2015 Fasold et al.
2001/0015500 A1 8/2001 Shimanuki et al.
2002/0023740 A1 2/2002 Lowenstein et al.
2002/0026797 A1 3/2002 Sundhar
2002/0098395 A1 7/2002 Shimanuki et al.
2002/0104439 A1 8/2002 Komkova et al.
2002/0139245 A1 10/2002 Kesten et al.
2002/0139320 A1 10/2002 Shimanuki et al.
2002/0148602 A1 10/2002 Nakamura
2003/0000230 A1 1/2003 Kopko
2003/0029185 A1 2/2003 Kopko
2003/0033821 A1 2/2003 Maisotsenko et al.
2003/0051498 A1 3/2003 Sanford
2003/0106680 A1 6/2003 Serpico et al.
2003/0121271 A1 7/2003 Dinnage et al.
2003/0230092 A1 12/2003 Lowenstein et al.
2004/0040697 A1 3/2004 Pierre et al.
2004/0061245 A1 4/2004 Maisotsenko et al.
2004/0109798 A1 6/2004 Chopard et al.
2004/0118125 A1 6/2004 Potnis et al.
2004/0134212 A1 7/2004 Lee et al.
2004/0168462 A1 9/2004 Assaf
2004/0194944 A1 10/2004 Hendricks et al.
2004/0211207 A1* 10/2004 Forkosh ..... F24F 3/1417 62/271
2004/0231512 A1 11/2004 Slayzak et al.
2005/0106021 A1 5/2005 Bunker et al.
2005/0109052 A1 5/2005 Albers et al.
2005/0133082 A1* 6/2005 Konold ..... H01L 31/0543 136/246
2005/0210907 A1 9/2005 Gillan et al.
2005/0218535 A1 10/2005 Maisotsenko et al.
2005/0257551 A1 11/2005 Landry
2006/0042295 A1 3/2006 Assaf
2006/0156750 A1 7/2006 Lowenstein et al.
2006/0278089 A1 12/2006 Theilow
2007/0169916 A1 7/2007 Wand et al.
2007/0175234 A1 8/2007 Pruitt
2007/0234743 A1 10/2007 Assaf

(56) References Cited

U.S. PATENT DOCUMENTS

| | | | | |
|---|---|---|---|---|
| 2008/0127965 | A1 | 6/2008 | Burton | |
| 2008/0156471 | A1 | 7/2008 | Han et al. | |
| 2008/0196758 | A1 | 8/2008 | McGuire | |
| 2008/0203866 | A1* | 8/2008 | Chamberlain | F24F 1/0007 312/236 |
| 2008/0302357 | A1 | 12/2008 | DeNault | |
| 2008/0314567 | A1 | 12/2008 | Noren | |
| 2009/0000732 | A1 | 1/2009 | Jacobine et al. | |
| 2009/0056919 | A1 | 3/2009 | Hoffman et al. | |
| 2009/0095162 | A1 | 4/2009 | Hargis et al. | |
| 2009/0173096 | A1* | 7/2009 | Wohlert | F25B 1/00 62/259.1 |
| 2009/0200022 | A1 | 8/2009 | Bravo et al. | |
| 2009/0238685 | A1 | 9/2009 | Santa Ana | |
| 2010/0000247 | A1 | 1/2010 | Bhatti et al. | |
| 2010/0018322 | A1 | 1/2010 | Neitzke et al. | |
| 2010/0051083 | A1 | 3/2010 | Boyk | |
| 2010/0084120 | A1 | 4/2010 | Yin et al. | |
| 2010/0170776 | A1 | 7/2010 | Ehrenberg et al. | |
| 2010/0319370 | A1* | 12/2010 | Kozubal | F24F 5/0035 62/92 |
| 2011/0100618 | A1 | 5/2011 | Carlson | |
| 2011/0101117 | A1* | 5/2011 | Miyauchi | B01D 53/1425 236/44 A |
| 2011/0126885 | A1 | 6/2011 | Kokotov et al. | |
| 2012/0052785 | A1 | 3/2012 | Nagamatsu et al. | |
| 2012/0114527 | A1 | 5/2012 | Hoglund et al. | |
| 2012/0118148 | A1 | 5/2012 | Culp et al. | |
| 2012/0118155 | A1 | 5/2012 | Claridge et al. | |
| 2012/0125020 | A1* | 5/2012 | Vandermeulen | F24F 3/1417 62/94 |
| 2012/0125021 | A1 | 5/2012 | Vandermeulen et al. | |
| 2012/0125031 | A1 | 5/2012 | Vandermeulen et al. | |
| 2012/0131937 | A1 | 5/2012 | Vandermeulen et al. | |
| 2012/0131939 | A1 | 5/2012 | Vandermeulen et al. | |
| 2012/0132513 | A1 | 5/2012 | Vandermeulen et al. | |
| 2012/0152318 | A1 | 6/2012 | Kee | |
| 2013/0056177 | A1 | 3/2013 | Coutu et al. | |
| 2013/0101909 | A1 | 4/2013 | Fasold et al. | |
| 2013/0186121 | A1 | 7/2013 | Erb et al. | |
| 2013/0199220 | A1 | 8/2013 | Ma et al. | |
| 2013/0227982 | A1 | 9/2013 | Forkosh | |
| 2013/0255287 | A1 | 10/2013 | Forkosh | |
| 2013/0340449 | A1 | 12/2013 | Kozubal et al. | |
| 2014/0054004 | A1 | 2/2014 | LePoudre et al. | |
| 2014/0054013 | A1 | 2/2014 | LePoudre et al. | |
| 2014/0150481 | A1 | 6/2014 | Vandermeulen | |
| 2014/0150656 | A1 | 6/2014 | Vandermeulen | |
| 2014/0150657 | A1 | 6/2014 | Vandermeulen et al. | |
| 2014/0150662 | A1 | 6/2014 | Vandermeulen et al. | |
| 2014/0223947 | A1 | 8/2014 | Ranjan et al. | |
| 2014/0245769 | A1 | 9/2014 | Vandermeulen et al. | |
| 2014/0250935 | A1 | 9/2014 | Prochaska et al. | |
| 2014/0260367 | A1 | 9/2014 | Coutu et al. | |
| 2014/0260369 | A1 | 9/2014 | LePoudre | |
| 2014/0260371 | A1 | 9/2014 | Vandermeulen | |
| 2014/0260398 | A1 | 9/2014 | Kozubal et al. | |
| 2014/0260399 | A1 | 9/2014 | Vandermeulen | |
| 2014/0262125 | A1 | 9/2014 | Erb et al. | |
| 2014/0262144 | A1 | 9/2014 | Erb et al. | |
| 2014/0264968 | A1 | 9/2014 | Erb et al. | |
| 2014/0360373 | A1 | 12/2014 | Peacos et al. | |
| 2014/0366567 | A1 | 12/2014 | Vandermeulen | |
| 2015/0338140 | A1 | 11/2015 | Vandermeulen | |

FOREIGN PATENT DOCUMENTS

| | | | |
|---|---|---|---|
| EP | 1563229 | A1 | 8/2005 |
| EP | 1781995 | A1 | 5/2007 |
| EP | 2256434 | A2 | 12/2010 |
| EP | 2306100 | A1 | 4/2011 |
| JP | 02306067 | A | 12/1990 |
| JP | H08-105669 | A | 4/1996 |
| JP | H11-351700 | A | 12/1999 |
| JP | 2002206834 | A | 7/2002 |
| JP | 2006-263508 | A | 10/2006 |
| JP | 2006-529022 | A | 12/2006 |
| JP | 04273555 | B2 | 6/2009 |
| JP | 2009-293831 | A | 12/2009 |
| JP | 2010-247022 | A | 11/2010 |
| JP | 2011-163682 | A | 8/2011 |
| KR | 20040026242 | A | 3/2004 |
| KR | 10-0510774 | B1 | 8/2005 |
| KR | 2014-0022785 | A | 2/2014 |
| WO | 9922180 | A1 | 5/1999 |
| WO | 0011426 | A1 | 3/2000 |
| WO | 0055546 | A1 | 9/2000 |
| WO | WO-02066901 | A1 | 8/2002 |
| WO | 03004937 | A1 | 1/2003 |
| WO | 2004046618 | A1 | 6/2004 |
| WO | 2006006177 | A1 | 1/2006 |
| WO | 2008037079 | A1 | 4/2008 |
| WO | 2009094032 | A1 | 7/2009 |
| WO | 2009144880 | A1 | 12/2009 |
| WO | 2011062808 | A1 | 5/2011 |
| WO | 2011161547 | A2 | 12/2011 |
| WO | 2012082093 | A1 | 6/2012 |

OTHER PUBLICATIONS

2—Open Absorption System for Cooling and Air Conditioning using Membrane Contactors—Annual, Report 2006, Publication No. Publication 260098, Project: 101310—Open Absorption System for Cooling and Air Conditioning using Membrane Contactors, Date of publication: Nov. 14, 2006, Author: Manuel Conde-Petit, Robert Weber, Contractor: M. Conde Engineering.

3—Open Absorption System for Cooling and Air Conditioning Using Membrane Contactors—Final Report, Publication No. Publication 280139, Project: 101310—Open Absorption System for Cooling and Air Conditioning using Membrane Contactors, Date of publication: Jul. 8, 2008, Author: Viktor Dorer, Manuel Conde-Petit, Robert Weber, Contractor: M. Conde Engineering.

4—Conde-Petit, M. 2007. Liquid Desiccant-Based Air-Conditioning Systems—LDACS, Proc. of the 1st European Conference on Polygeneration—Technologies and Applications, 217-234, A. Coronas, ed., Tarragona—Spain, Oct. 16-17, Published by CREVER—Universitat Rovira I Virgili, Tarragona, Spain.

5—Conde-Petit, M. 2008. Open Absorption Systems for Air-Conditioning using Membrane Contactors,Proceedings '15. Schweizerisches Status-Seminar <<Energie- und Umweltforschung im Bauwesen>>, Sep. 11-12—ETH Zurich, Switzerland. Published by BRENET—Eggwilstr. 16a, CH-9552 Bronschhofen—Switzerland (brenet@vogel-tech.ch).

6—Third Party Observations for PCT/US2011/037936, dated Sep. 24, 2012.

Ashrae, et al., "Desiccant Dehumidification and Pressue Drying Equipment," 2012 Ashrae Handbook—HVAC Systems and Equipment, Chapter 24, pp. 24.1-24.12.

Beccali, et al., "Energy and Economic Assessment of Desiccant Cooling," Solar Energy, Issue 83, pp. 1828-1846, Aug. 2009.

Fimbres-Weihs, et al., "Review of 3D CFD modeling of flow and mass transfer in narrow spacer-filled channels in membrane modules," Chemical Engineering and Processing 49 (2010) pp. 759-781.

Li, F. et al., "Novel spacers for mass transfer enhancement in membrane separations," Journal of Membrane Science, 253 (2005), pp. 1-12.

Li, Y., et al., "CFD simulation of fluid flow through spacer-filled membrane module: selecting suitable cell types for periodic boundary conditions," Desalination 233 (2008) pp. 351-358.

Liu, et al., "Research Progress in Liquid Desiccant Air Conditioning Devices and Systems," Frontiers of Energy and Power Engineering in China, vol. 4, Issue 1, pp. 55-65, Feb. 2010.

Lowenstein, "A Solar Liquid-Desiccant Air Conditioner," Solar 2003, Proceedings of the 32nd ASES Annual Conference, Austin, TX, Jul. 2003.

Mathioulakis, "Desalination by Using Alternative Energy," Desalination, Issue 203, pp. 346-365, 2007.

(56) References Cited

OTHER PUBLICATIONS

Russell, et al., "Optimization of Photovolatic Thermal Collector Heat Pump Systems," ISES International Solar Energy Conference, Atlanta, GA, vol. 3, pp. 1870-1874, May 1979.
Welty, "Liquid Desiccant Dehumidification," Engineered Systems, May 2010, vol. 27 Issue 5, p. 34.
International Search Report and Written Opinion for PCT/2014/028124, dated Aug. 22, 2014.
"Siphon." Encyclopedia Americana. Grolier Online, 2015. Web. Apr. 3, 2015. 1 page.
Perry "Perry's Chemical Engineers handbook" 1999 McGraw Hill p. 11-52, 11-53.
Korean Patent Application 10-2015-7025387, Office Action dated Aug. 26, 2016.
European Supplemental Search Report for EP14770288.0, dated Dec. 15, 2016.
Chinese Patent Application 201480015033.1, Office Action dated Mar. 21, 2017.
Korean Patent Application 10-2015-7025387, Office Action dated Apr. 27, 2017.

* cited by examiner

METHODS AND SYSTEMS FOR LIQUID DESICCANT AIR CONDITIONING SYSTEM RETROFIT

CROSS REFERENCE TO RELATED APPLICATION

This application claims priority from U.S. Provisional Patent Application No. 61/782,579 filed on Mar. 14, 2013 entitled METHODS AND SYSTEMS FOR LIQUID DESICCANT AIR CONDITIONING SYSTEM RETROFIT, which is hereby incorporated by reference.

BACKGROUND

The present application relates generally to the use of liquid desiccants to dehumidify and cool, or heat and humidify an air stream entering a space. More specifically, the application relates to an optimized system configuration to retrofit 2- or 3-way liquid desiccant mass and heat exchangers that employ micro-porous membranes to separate the liquid desiccant from an air stream in large commercial and industrial buildings while at the same time modifying existing Heating Ventilation and Air Conditioning (HVAC) equipment to achieve a significant reduction in electricity consumption in the building.

Desiccant dehumidification systems—both liquid and solid desiccants—have been used parallel to conventional vapor compression HVAC equipment to help reduce humidity in spaces, particularly in spaces that require large amounts of outdoor air or that have large humidity loads inside the building space itself. (ASHRAE 2012 Handbook of HVAC Systems and Equipment, Chapter 24, p. 24.10). Humid climates, such as for example Miami, Fla. require a lot of energy to properly treat (dehumidify and cool) the fresh air that is required for a space's occupant comfort. Conventional vapor compression systems have only a limited ability to dehumidify and tend to overcool the air, oftentimes requiring energy intensive reheat systems, which significantly increase the overall energy costs, because reheat adds an additional heat-load to the cooling coil. Desiccant dehumidification systems—both solid and liquid—have been used for many years and are generally quite efficient at removing moisture from the air stream. However, liquid desiccant systems generally use concentrated salt solutions such as ionic solutions of LiCl, LiBr or $CaCl_2$ and water. Such brines are strongly corrosive, even in small quantities, so numerous attempts have been made over the years to prevent desiccant carry-over to the air stream that is to be treated. In recent years efforts have begun to eliminate the risk of desiccant carry-over by employing micro-porous membranes to contain the desiccant.

Liquid desiccant systems generally have two separate functions. The conditioning side of the system provides conditioning of air to the required conditions, which are typically set using thermostats or humidistats. The regeneration side of the system provides a reconditioning function of the liquid desiccant so that it can be re-used on the conditioning side. Liquid desiccant is typically pumped between the two sides. A control system is used to properly balance the liquid desiccant between the two sides as conditions necessitate and that excess heat and moisture are properly dealt with without leading to over-concentrating or under-concentrating the desiccant.

In large stores, supermarkets, commercial and industrial buildings, energy is wasted because the existing unitary HVAC units serving the building do not adequately dehumidify the ventilation air that they provide to the building. This excess humidity winds up being condensed out of the air with excess energy usage from refrigeration and freezer equipment inside the building, which creates a load on that equipment resulting in a higher than necessary energy consumption.

Older buildings typically have been designed with HVAC equipment that recirculates a large portion (80-90%) of the air from the space through its cooling coil. The equipment takes in approximately 10-20% of fresh outside air, which as discussed above requires dehumidification, which is not adequately done by this equipment. At time of construction and design, engineers will sometime add a desiccant system to create the necessary dehumidification, but such equipment is heavy, complex and expensive and is not retrofitable on buildings that were not originally designed to accommodate them.

There thus remains a need to provide a retrofitable cooling system for buildings with high humidity loads, wherein the dehumidification of outside air can be accommodated at low capital and energy costs.

BRIEF SUMMARY

Provided herein are methods and systems used for the efficient cooling and dehumidification of an air stream in a large commercial or industrial building using a liquid desiccant. In accordance with one or more embodiments, the liquid desiccant flows down the face of a support plate as a falling film. In accordance with one or more embodiments, the desiccant is contained by a microporous membrane, and the air stream is directed in a primarily vertical or primarily horizontal orientation over the surface of the membrane and whereby both latent and sensible heat are absorbed from the air stream into the liquid desiccant. In accordance with one or more embodiments, the support plate is filled with a heat transfer fluid that ideally flows in a direction counter to the air stream. In accordance with one or more embodiments, the system comprises a conditioner that removes latent and sensible heat through the liquid desiccant into the heat transfer fluid and a regenerator that rejects the latent and sensible heat from the heat transfer fluid to the environment. In accordance with one or more embodiments, the heat transfer fluid in the conditioner is cooled by a refrigerant compressor or an external source of cold heat transfer fluid. In accordance with one or more embodiments, the regenerator is heated by a refrigerant compressor or an external source of hot heat transfer fluid. In accordance with one or more embodiments, the refrigerant compressor is reversible to provide heated heat transfer fluid to the conditioner and cold heat transfer fluid to the regenerator, and the conditioned air is heated and humidified and the regenerated air is cooled and dehumidified.

In accordance with one or more embodiments, a liquid desiccant membrane system employs an indirect evaporator to generate a cold heat transfer fluid wherein the cold heat transfer fluid is used to cool a liquid desiccant conditioner. Furthermore in one or more embodiments, the indirect evaporator receives a portion of the air stream that was earlier treated by the conditioner. In accordance with one or more embodiments, the air stream between the conditioner and indirect evaporator is adjustable through some convenient means, for example through a set of adjustable louvers or through a fan with adjustable fan speed. In one or more embodiments, the water supplied to the indirect evaporator is seawater. In one or more embodiments, the water is waste water. In one or more embodiments, the indirect evaporator uses a membrane to inhibit or prevent carry-over of non-desirable elements from the seawater or waste water. In one or more embodiments, the water in the indirect evaporator is not cycled back to the top of the indirect evaporator such as would happen in a cooling tower, but between 20% and 80% of the water is evaporated and the remainder is discarded.

In accordance with one or more embodiments, the indirect evaporator is used to provide heated, humidified air to a supply air stream to a space while a conditioner is simultaneously used to provide heated, humidified air to the same space. This allows the system to provide heated, humidified air to a space in winter conditions. The conditioner is heated and is desorbing water vapor from a desiccant and the indirect evaporator can be heated as well and is desorbing water vapor from liquid water. In combination the indirect evaporator and conditioner provide heated humidified air to the building space for winter heating conditions.

In accordance with one or more embodiments, some number of Liquid Desiccant Air Conditioning systems (LDACs) is installed at existing large stores, supermarkets or other commercial or industrial buildings to replace a subset of the existing unitary heating ventilating and air conditioning (HVAC) recirculating rooftop units (RTUs) already present. In accordance with one or more embodiments, the new liquid desiccant air conditioning units are operated to provide heated or cooled 100% outside air ventilation to the conditioned space. In accordance with one or more embodiments, the remaining RTUs are modified in such a way that they no longer supply outside air to the space, but become 100% recirculating RTU's. In one or more embodiments, the modification is achieved by removing power to a damper motor. In one or more embodiments, the modification is achieved by removing a lever from a damper mechanism. In accordance with one or more embodiments, the remaining RTUs are modified to have a higher evaporator temperature so that moisture no longer condenses on the evaporator coils and the unit becomes more energy efficient. In one or more embodiments, the increase in evaporator temperature is achieved by replacing an expansion valve. In one or more embodiments, the increase in evaporator temperature is achieved by adding an APR valve such as the valve assembly supplied by Rawal Devices, Inc. of Woburn, Mass. In one or more embodiments, the increase in evaporator temperature is achieved by adding a hot-gas bypass system or some other convenient means of increasing the evaporator temperature.

In accordance with one or more embodiments, the new liquid desiccant air conditioning units provide all of the cooled, dehumidified outside air ventilation required by the building during the cooling season and warm humidified outside air ventilation during the heating season. The remaining existing unitary HVAC units have their outside air dampers shut so that they only provide heating or cooling of the indoor air. The benefit of this system retrofit that the new LDACs are more energy efficient and effective at dehumidifying the required ventilation air than the unitary HVAC units they replace. Another benefit of this system approach is that by the improved ability to reduce the space humidity in the building, the energy used by refrigeration and freezer units inside of the conditioned space is significantly reduced because they waste less energy having to condense humidity out of the air. Furthermore by modifying the remaining RTUs their energy consumption is also reduced. And lastly the advantage of replacing only a portion of the RTUs the cost of the upgrade is relatively minor since one can elect to replace mostly the oldest RTUs that are due for replacement anyway and payback periods are short because of the low upgrade cost and large energy savings.

In accordance with one or more embodiments, a liquid desiccant air conditioning system is constructed of repeatable membrane module elements and membrane module support tubs. In one or more embodiments, the scalable membrane modules are sized so as to fit through a standard access hatch for a roof with an opening of about 2.5 ft×2.5 ft. In one or more embodiments, the repeatable module support tubs are arranged in a linear fashion in such a way that the module support tubs form a support structure and an air duct simultaneously. In one or more embodiments, the module support tubs are hollow. In one or more embodiments, the module support tubs have double walls so that they can hold a liquid. In one or more embodiments, the liquid is a liquid desiccant. In one or more embodiments, the liquid desiccant is stratified with higher concentrations near the bottom and lower concentrations near the top of the tub. In one or more embodiments, the tub bottom is sloped so as the conduct any spilled liquid to a single corner of the tub. In one or more embodiments, the corner is equipped with a sensor or detector that can detect if any liquid has collected in the corner. In one or more embodiments, such a sensor is a conductivity sensor. In one or more embodiments, the module support tubs have openings on both ends. In one or more embodiments, the two ends are used to provide two different air streams into a series of support tubs. In one or more embodiments, the air streams are a return air stream and an outside air air-stream.

In accordance with one or more embodiments, a first series of membrane modules and module support tubs are arranged in a primarily linear fashion with a duct section that allows for a majority of air to be entered into a building and a portion of air to transported to a second series of membrane modules and module support tub sections. In one or more embodiments, the first series of modules and support tubs contain a membrane conditioner. In one or more embodiments, the membrane conditioner contains a desiccant behind the membrane. In one or more embodiments, the second series of modules contain a membrane conditioner. In one or more embodiments, the second conditioner contains water behind the membrane. In one or more embodiments, the water is seawater. In one or more embodiments, the water is waste water. In one or more embodiments, the water is potable water. In one or more embodiments, the air flow in the second series of membrane modules and module support tubs is reversible. In one or more embodiments, the first series of membrane modules receives a hot heat transfer fluid in winter mode from a heat source and receives a cold heat transfer fluid in summer mode. In one or more embodiments, the second series of membrane modules supplies the cold heat transfer fluid to the first series of membrane module in cooling mode and receives a hot heat transfer fluid from a heat source in winter mode. In one or more embodiments, the first series and second series of modules receive hot heat transfer fluid from the same heat source in winter mode.

In no way is the description of the applications intended to limit the disclosure to these applications. Many construction variations can be envisioned to combine the various elements mentioned above each with its own advantages and disadvantages. The present disclosure in no way is limited to a particular set or combination of such elements.

DETAILED DESCRIPTION

Figure 1:
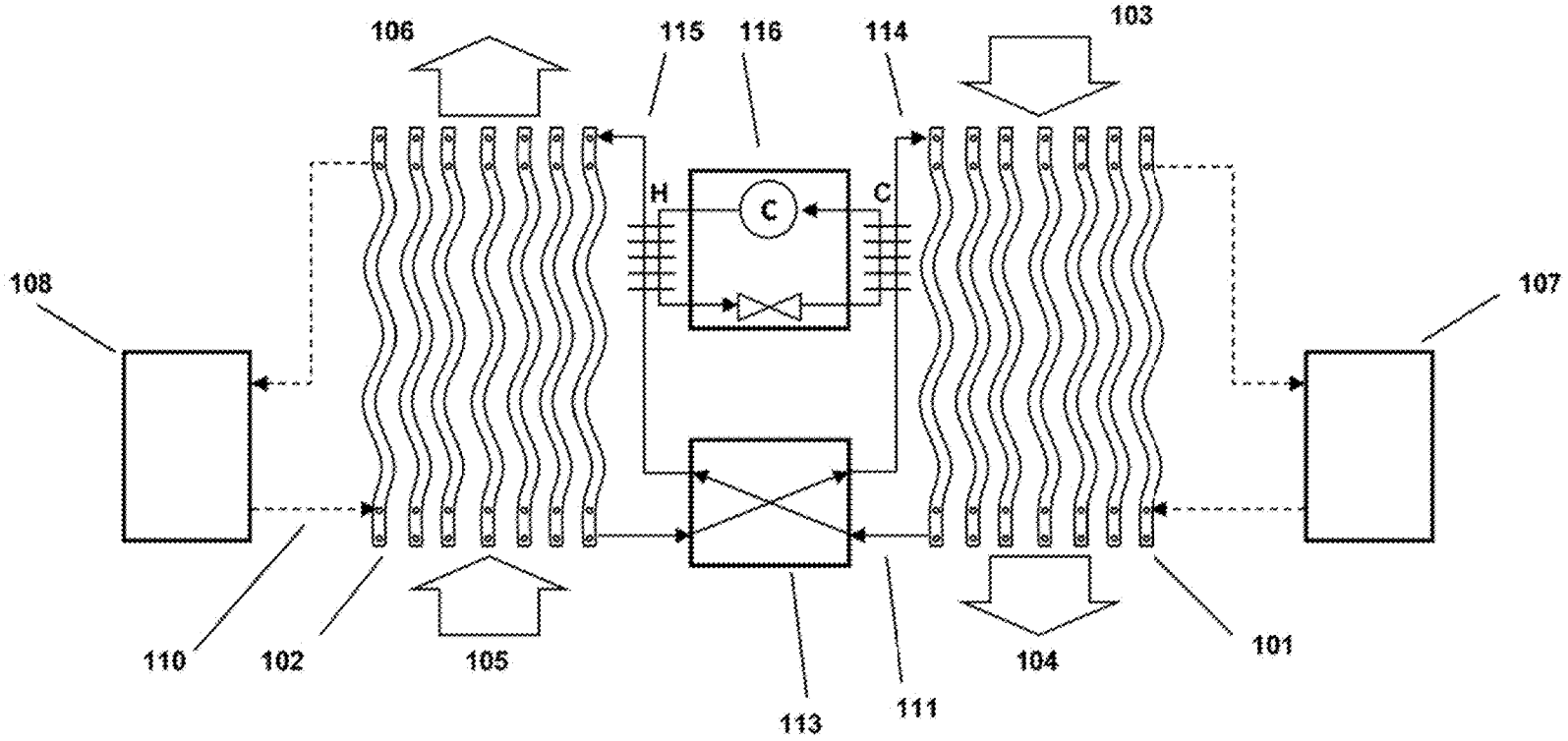
FIG. 1 illustrates an exemplary 3-way liquid desiccant air conditioning system using a chiller or external heating or cooling sources.

FIG. 1 depicts a new type of liquid desiccant system as described in more detail in U.S. Patent Application Publication No. US 20120125020, which is incorporated by reference herein. A conditioner 101 comprises a set of plate structures that are internally hollow. A cold heat transfer fluid is generated in cold source 107 and entered into the plates. Liquid desiccant solution at 114 is brought onto the outer surface of the plates and runs down the outer surface of each of the plates. The liquid desiccant runs behind a thin membrane that is located between the air flow and the surface of the plates. Outside air 103 is now blown through the set of wavy plates. The liquid desiccant on the surface of the plates attracts the water vapor in the air flow and the cooling water inside the plates helps to inhibit the air temperature from rising. The treated air 104 is put into a building space.

The liquid desiccant is collected at the bottom of the wavy plates at 111 and is transported through a heat exchanger 113 to the top of the regenerator 102 to point 115 where the liquid desiccant is distributed across the wavy plates of the regenerator. Return air or optionally outside air 105 is blown across the regenerator plate and water vapor is transported from the liquid desiccant into the leaving air stream 106. An optional heat source 108 provides the driving force for the regeneration. The hot transfer fluid 110 from the heat source can be put inside the wavy plates of the regenerator similar to the cold heat transfer fluid on the conditioner. Again, the liquid desiccant is collected at the bottom of the wavy plates 102 without the need for either a collection pan or bath so that also on the regenerator the air flow can be horizontal or vertical. An optional heat pump 116 can be used to provide cooling and heating of the liquid desiccant. It is also possible to connect a heat pump between the cold source 107 and the hot source 108, which is thus pumping heat from the cooling fluids rather than the desiccant.

Figure 2:
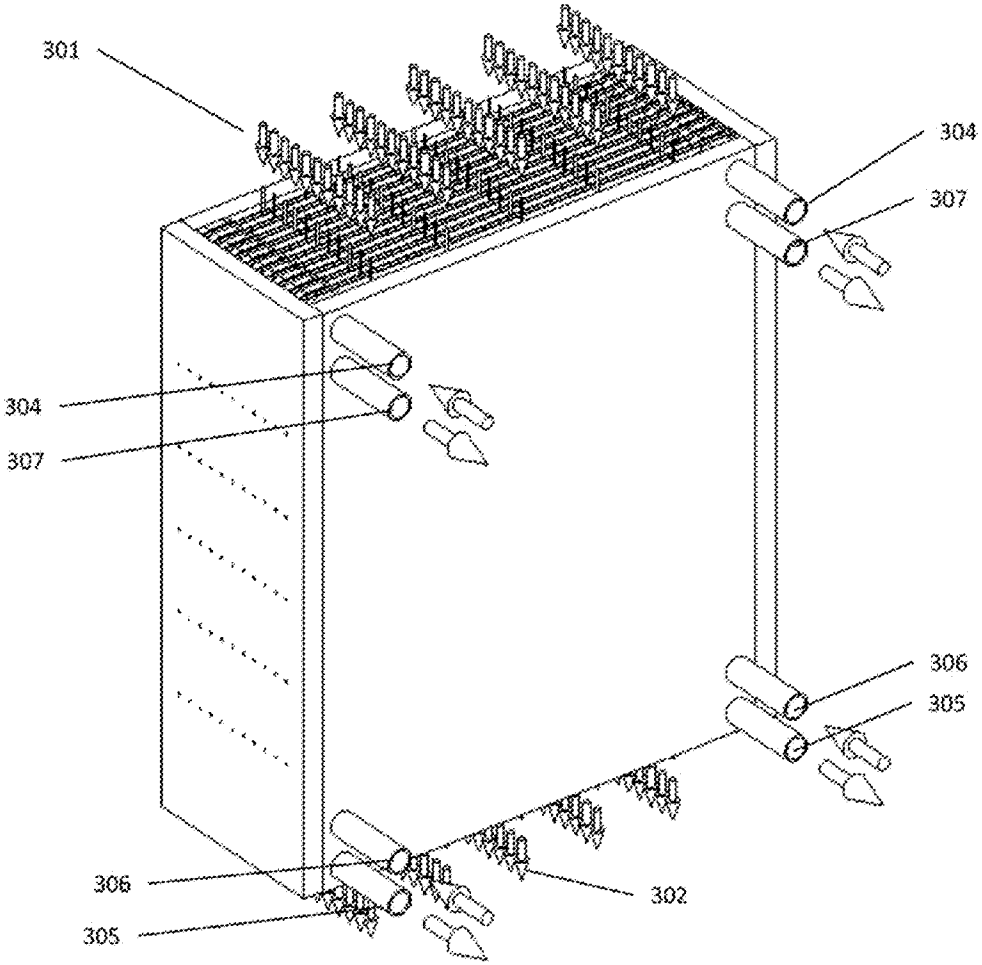
FIG. 2 shows an exemplary flexibly configurable membrane module that incorporates 3-way liquid desiccant plates.

FIG. 2 describes a 3-way heat exchanger as described in further detail in U.S. patent application Ser. No. 13/915,199 filed on Jun. 11, 2013, Ser. No. 13/915,222 filed on Jun. 11, 2013, and Ser. No. 13/915,262 filed on Jun. 11, 2013, which are all incorporated by reference herein. A liquid desiccant enters the structure through ports 304 and is directed behind a series of membranes as described in FIG. 1. The liquid desiccant is collected and removed through ports 305. A cooling or heating fluid is provided through ports 306 and runs counter to the air stream 301 inside the hollow plate structures, again as described in FIG. 1 and in more detail in FIG. 3. The cooling or heating fluids exit through ports 307. The treated air 302 is directed to a space in a building or is exhausted as the case may be.

Figure 3:
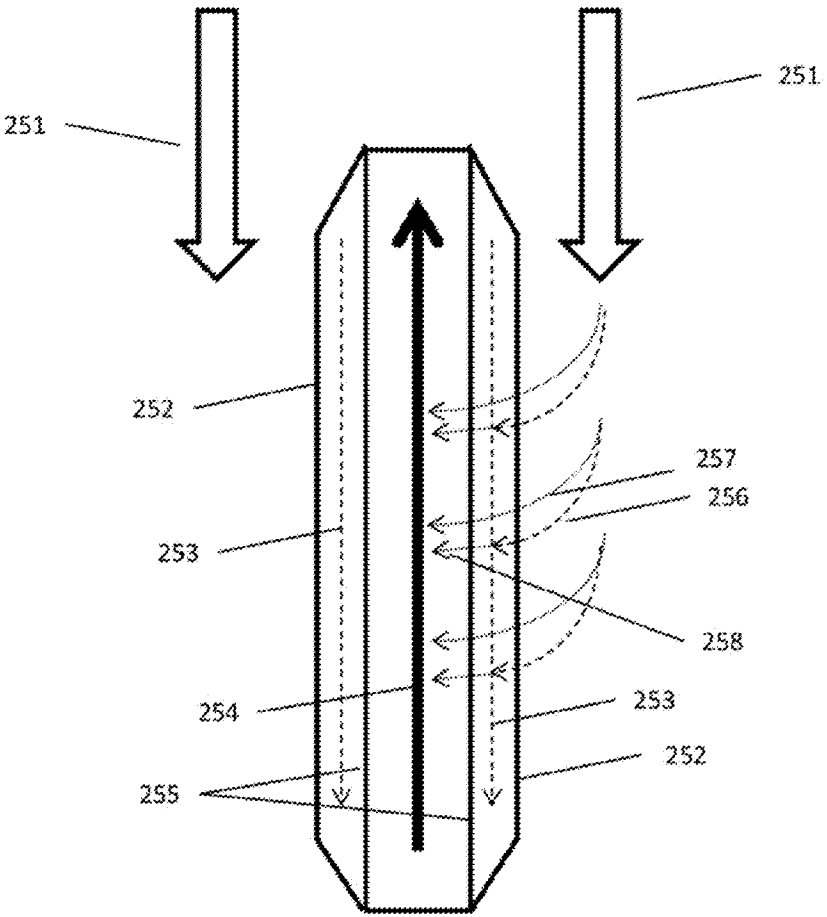
FIG. 3 illustrates an exemplary single membrane plate in the liquid desiccant membrane module of FIG. 2.

FIG. 3 describes a 3-way heat exchanger as described in more detail in U.S. Provisional Patent Application Ser. No. 61/771,340 filed on Mar. 1, 2013, which is incorporated by reference herein. The air stream 251 flows counter to a cooling fluid stream 254. Membranes 252 contain a liquid desiccant 253 that is falling along the wall 255 that contain a heat transfer fluid 254. Water vapor 256 entrained in the air stream is able to transition the membrane 252 and is absorbed into the liquid desiccant 253. The heat of condensation of water 258 that is released during the absorption is conducted through the wall 255 into the heat transfer fluid 254. Sensible heat 257 from the air stream is also conducted through the membrane 252, liquid desiccant 253 and wall 255 into the heat transfer fluid 254.

Figure 4:
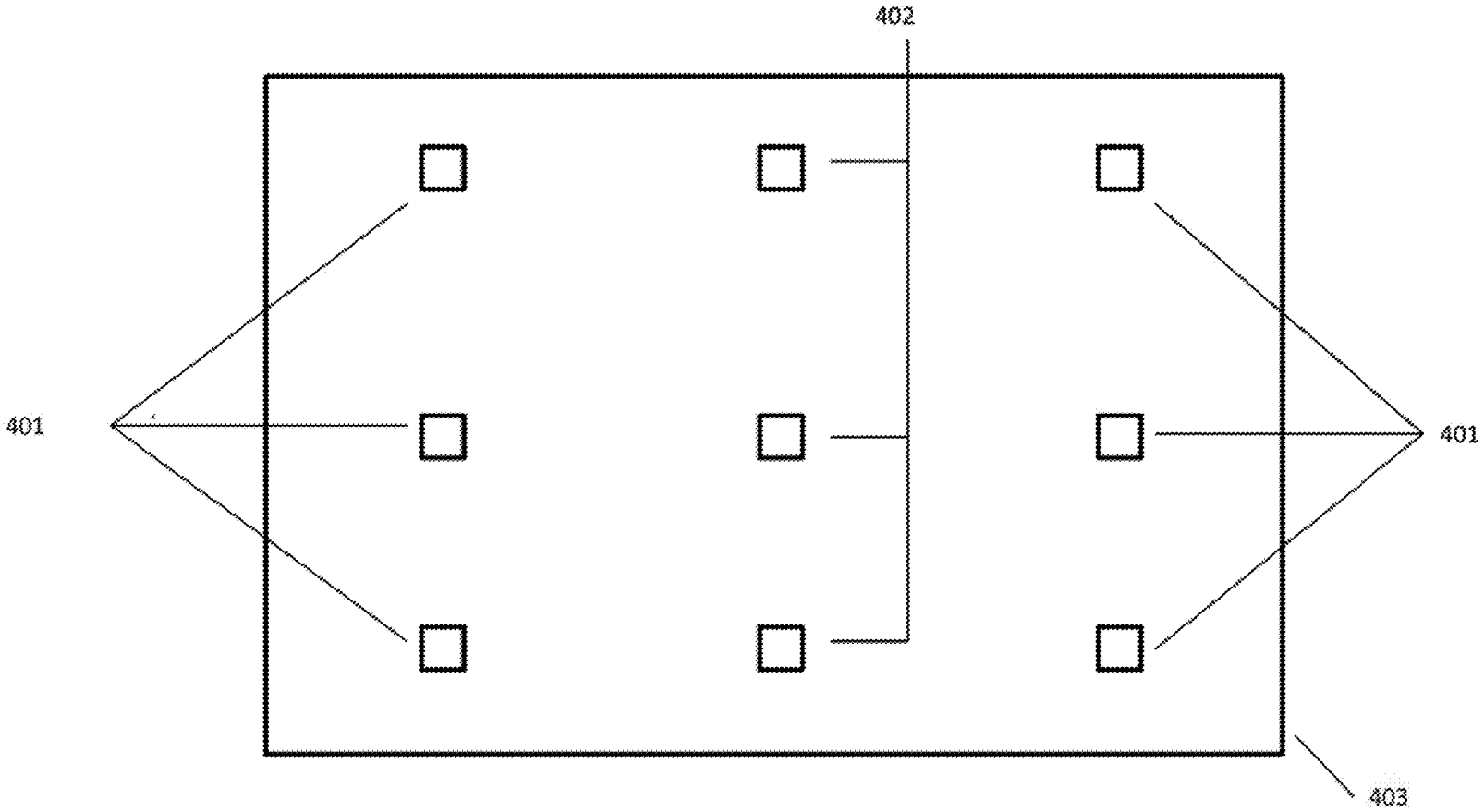
FIG. 4 shows an exemplary building roof layout showing existing rooftop units (RTUs) and RTUs that would be replaced as part of a retrofit.

FIG. 4 shows an example of a commercial or industrial building 403 rooftop. Some of the existing Roof Top Units (RTUs) 401 are kept in place and modified to provide only sensible cooling and are further modified to no longer accept outside air. A few (typically 1 in 3 to 1 in 5) of the unitary rooftop units 402 are to be replaced with new liquid desiccant air conditioning (LDAC) dedicated outdoor air units (DOAS). The replacement units 402 are chosen based on age of the equipment that they are replacing as well as based on the air distribution requirements to ensure that fresh air is distributed evenly in the space.

Figure 5:
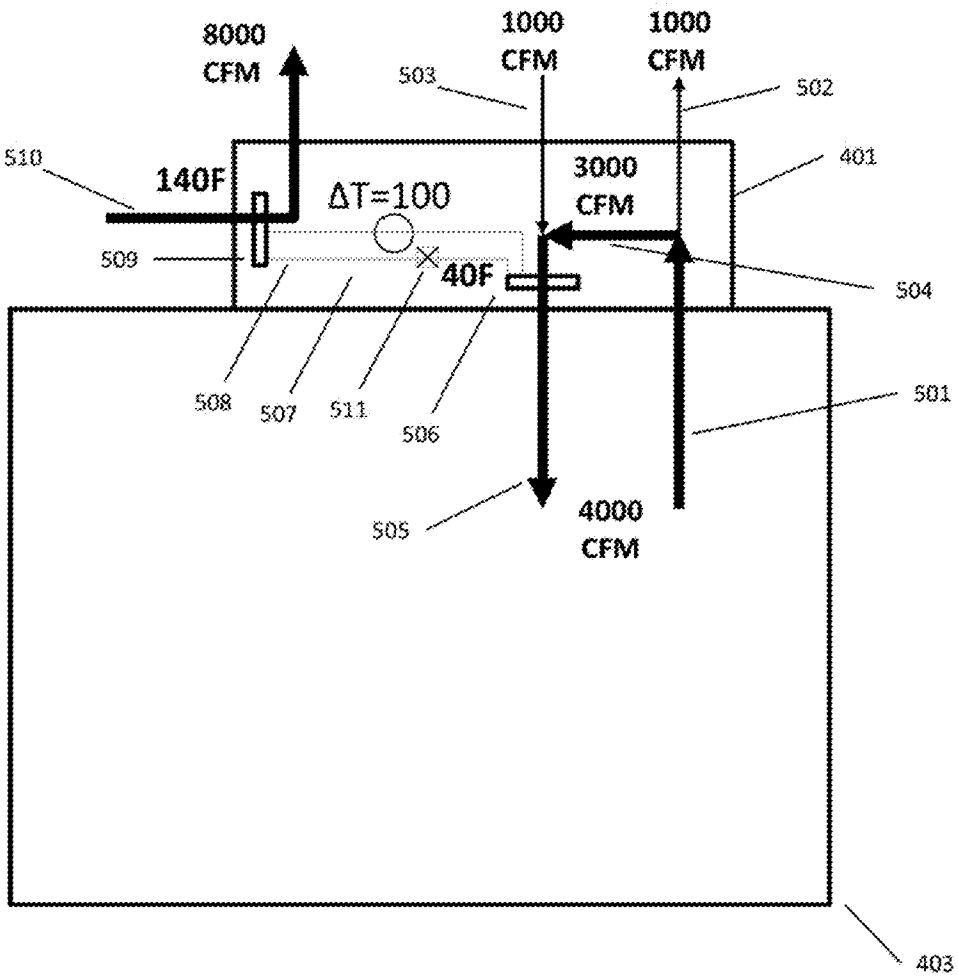
FIG. 5 shows a schematic aspect of an exemplary recirculating rooftop unit on a building space.

FIG. 5 shows a schematic diagram of a typical RTU 401 installed on a building 403. The RTU will have between 10 and 25% outside air 503 and provide about 300-400 Cubic Feet per Minute (CFM) of total air flow per ton of cooling capacity. A typical 10 ton RTU will thus provide about 3,000 to 4,000 CFM of total air 505 with 300 to 1,000 CFM of outside air mixed in. It is well known that the outside ventilation air can represent more than 60% of the humidity load in grocery stores. (ASHRAE 2012 Handbook of HVAC Systems and Equipment, Chapter 24, p. 24.10). The air 505 supplied to the space is nearly 100% saturated unless some form of reheating is employed. Reheating however adds a significant heat load to the cooling coil since a lot of air 501 that is returned to the RTU 401 is internally directed 504 to the cooling coil and a small portion 502 is exhausted, typically about the same amount as the RTU took in. The evaporator coil 506 is providing the primary cooling function of the mixed air stream 503 and 504. Compressor 507 is providing a refrigerant 508 and rejecting its heat to condenser 509. A typical condenser will have some 800 CFM of outside air 510 per ton of cooling, or about 8,000 CFM for a 10 ton unit. An expansion valve 511 provides the cold liquid refrigerant to the evaporator coil 506.

Figure 6:
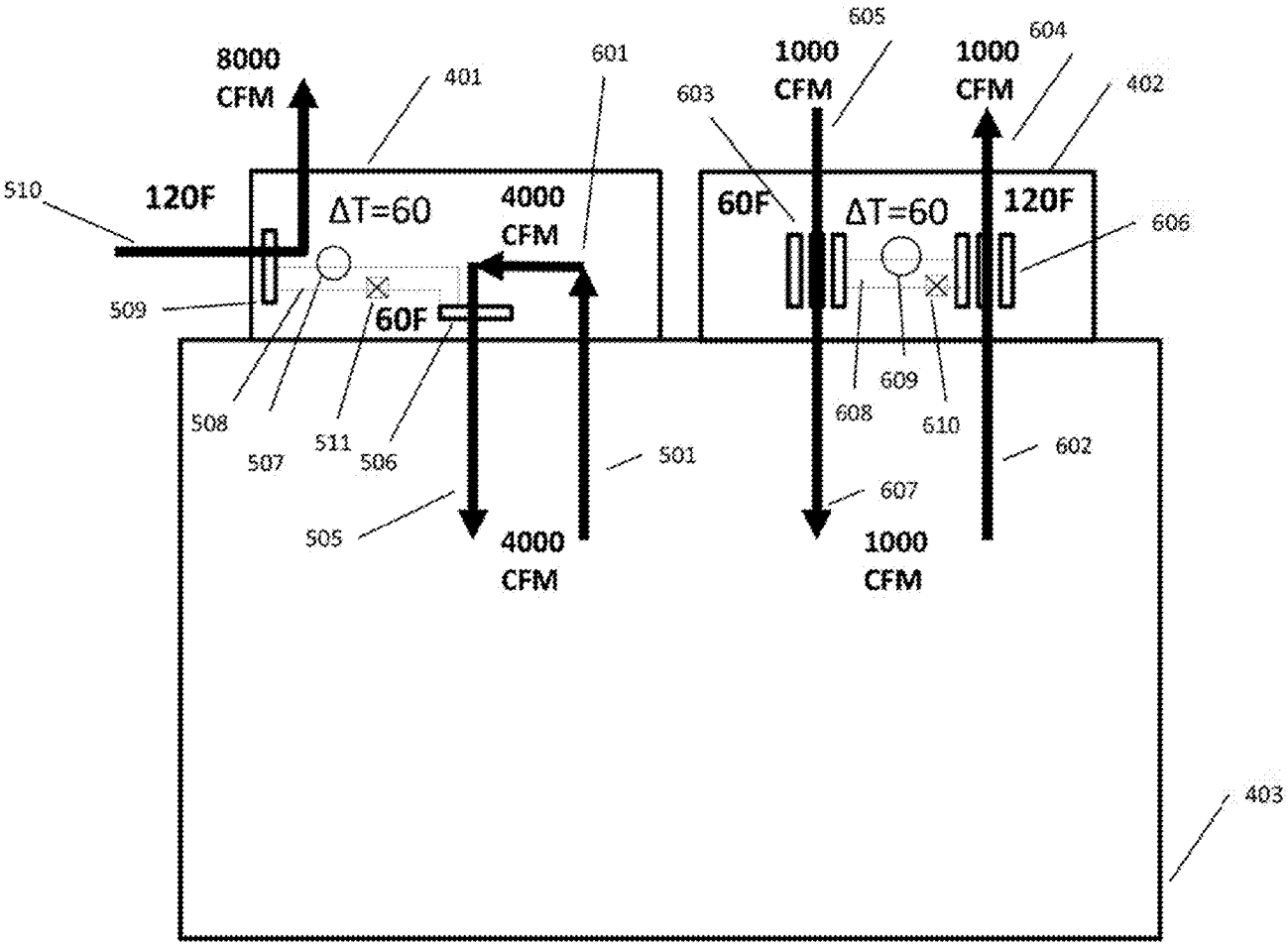
FIG. 6 shows a schematic aspect of an exemplary modified recirculating rooftop unit assisted by a liquid desiccant dedicated outdoor air system.

FIG. 6 shows how the RTU 401 of FIGS. 4 and 500 can be modified and supplemented by a liquid desiccant dedicated outdoor air system 402. The RTU 401 has been modified to no longer provide or take in outside air. As a result only return air 501 from the building is recirculated 601 through the evaporator coil 506. Alternatively, the RTU is modified to reduce the intake of outside air. The evaporator temperature has also been increased from a normal 40 F to about 50-60 F. There are several ways that this can be accomplished: one can replace the expansion valve 511 with a different valve 610 set for a higher evaporator temperature. Other ways to increase the evaporator temperature is for example to provide an APR bypass valve made by Rawal Devices, Inc., Woburn, Mass. 01888-0058. By increasing evaporator temperature the cooling load of the remaining RTU is reduced and the system operates more efficiently.

One of the RTUs is replaced with a liquid desiccant system 402 as discussed earlier. The main liquid desiccant system components are the conditioner 603—which can be like component 101 in FIG. 1 and the regenerator 606—which can be like component 102 in FIG. 1. An optional compressor 609 pumps heat from the conditioner to the regenerator using refrigerant 608 and using expansion valve 610. Outside air 605 is brought through the conditioner 606 and supplied 607 at a lower temperature and humidity than the space requires. Return air 602 enters the regenerator 606 where it picks up heat and moisture after which is exhausted 604. (In case return air is unavailable for the liquid desiccant system 402, the air stream 602 can comprise outside air.) The liquid desiccant system is sized in such a way that it provides all of the outside air as was previously provided by the recirculating RTU's 401. Since the LDAC is providing dry, cool air, the space itself is much drier which will reduce the load on refrigeration equipment and freezers in the space.

Figure 7:
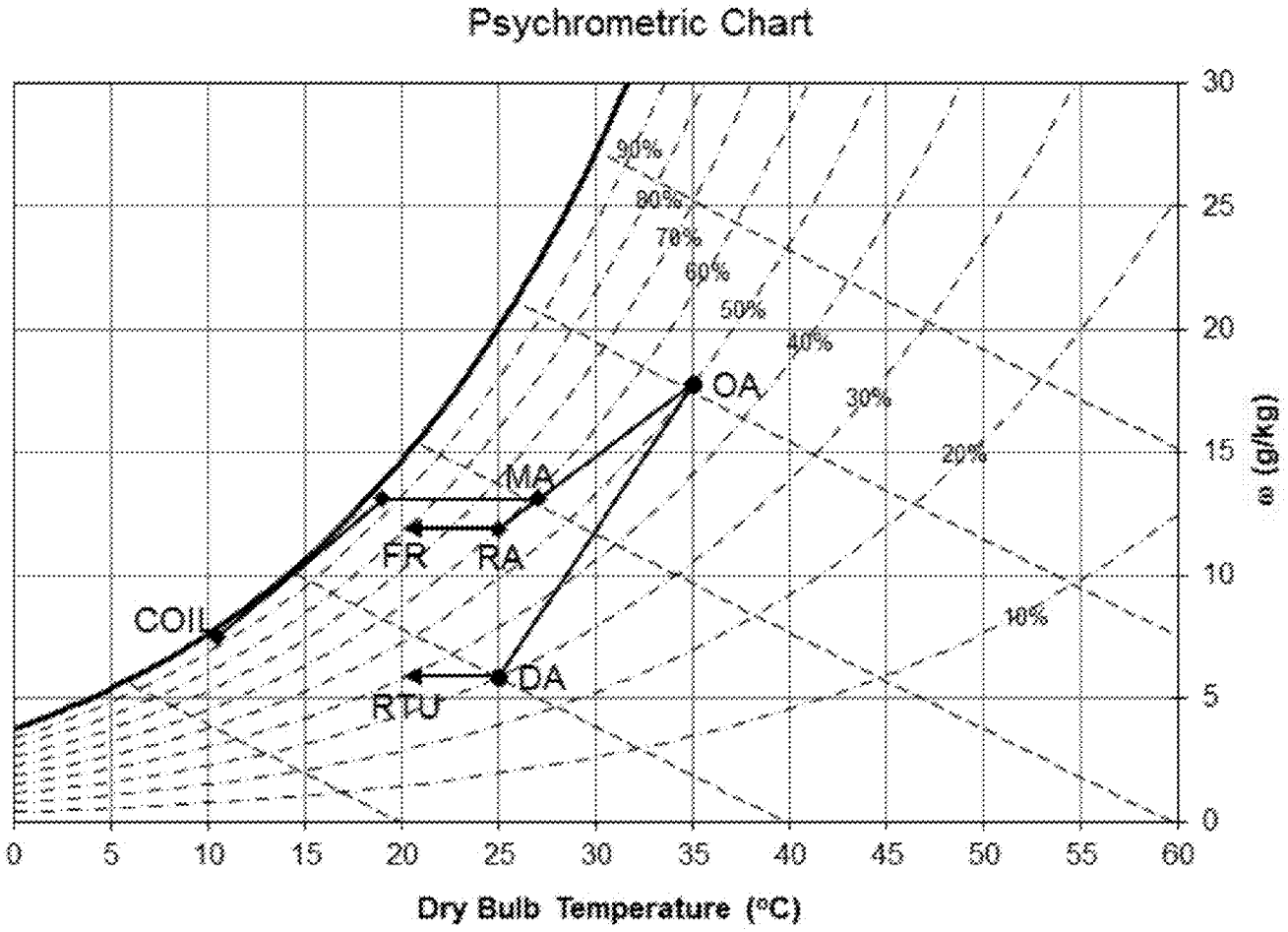
FIG. 7 depicts a psychrometric chart showing the processes of an exemplary recirculating rooftop unit as well as the liquid desiccant dedicated outdoor air system.

FIG. 7 shows a psychrometric chart of the processes involved in the recirculating RTU and the liquid desiccant system. A conventional RTU takes in 10-25% of outside air ("OA") and mixes that air with return air from the building ("RA"). The resulting mixed air ("MA") point is determined by the amount of outside and return air that is combined. The cooling coil 506 subsequently takes the mixed air ("MA") and cools it to the saturation line where water vapor condenses out and ultimately supplies air to the space at low temperature but near saturation level ("COIL"). This air needs to be heated by the building somehow, which on hot sunny days can be naturally done, but on cloudy days or mid temperature days may not occur unless an additional reheat system is employed. In supermarkets, grocery stores and the like, the refrigeration cases and freezers can provide an additional cooling effect, indicated by the arrow ("FR") from the return air position ("RA"). As can be seen in the figure, the additional sensible cooling provided by the freezers and refrigerators and a lack of reheat, result in a space that is too cold and too humid, with relative humidity exceeding 70%. Furthermore, water sprayers in vegetable sections and short cycling of the RTU's make this situation even worse.

The liquid desiccant air conditioning system of FIG. 6 however, also takes in outside air ("OA") and produces cooler, dry air ("DA") to the space. The additional cooling by the remaining RTUs and freezers and refrigerators ("RTU") results in a much smaller increase in relative humidity which can be avoided by simply not operating the RTU's unless necessary.

Figure 8:
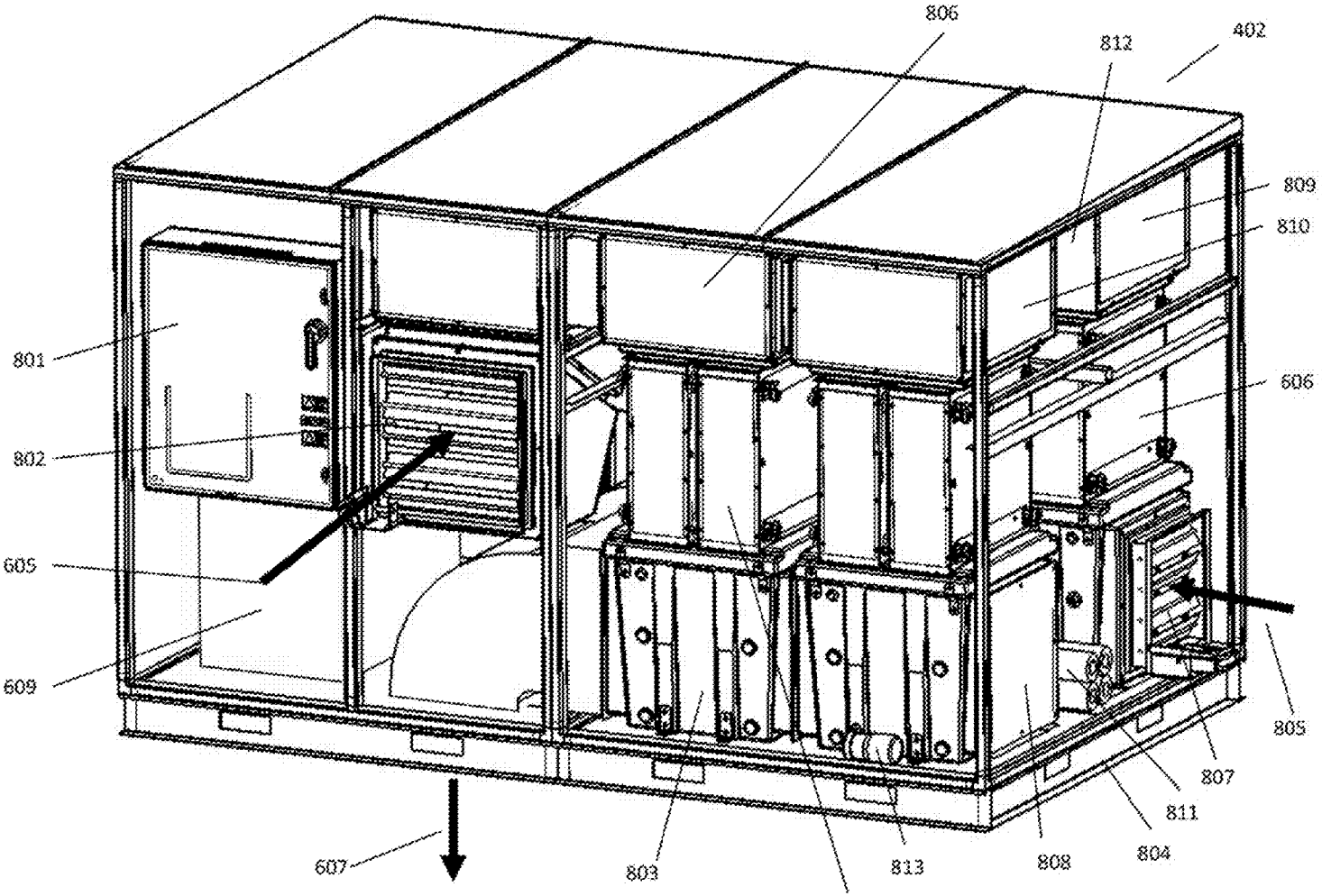
FIG. 8 shows an implementation of an exemplary scalable liquid desiccant dedicated outdoor air system.

FIG. 8 illustrates an embodiment of a liquid desiccant air conditioning system (LDAC) 402 that is able to provide cool, dry air to a space from 100% outside air. Several of the components in the system of FIG. 8 have been identified in FIG. 6. The conditioner modules 603 (of which there are 4 in this example), contain the membrane plate structures as were shown in FIGS. 1-3. Similarly the regenerator modules 606 (of which there are also 4 in this example) have similar construction to the conditioner modules. Outside air 605 is entering the conditioner section through louvers 802. The outside air is then transported through optional internal ducts 806, downward through the conditioner modules 603 and then through the tub modules 803 to exit the system as supply air 607. The return air from the building (not shown) receives some additional outside air 805 through louvers 807. This air is then transported through regenerator modules 606 and regenerator duct modules 812 and eventually exhausted out of the system (not shown). A power interface module 801 and an integral chiller/heat pump system 609 provide electrical facilities and hot and cold water for the regenerator and conditioner modules respectively. As shown in the figure, the system has 4 conditioner and 4 regenerator modules, mounted 2 at a time on tub supports 803. The size of the modules was chosen such that they are able to fit through standard roof access hatches. As can be seen from the figure, it would be very easy to add additional tub modules 803 and membrane conditioner or regenerator modules 603 and 606. The right side of the system of FIG. 10 is terminated by removable end plate 808 for the conditioner tub modules, removable end plate 810 for the conditioner duct 806, and removable end plate 809 for the regenerator duct. Cold water supply and cold water return and hot water supply and hot water return are shown as item 811 in the figure. The louver 807 is mounted to the last tub module and is easily removed and mounted on a different tub module. Also shown is one of the desiccant pumps 813 which will be discussed in more detail under FIG. 9A and FIG. 12. The whole system is mounted on a modular support frame 804.

Figure 9B:
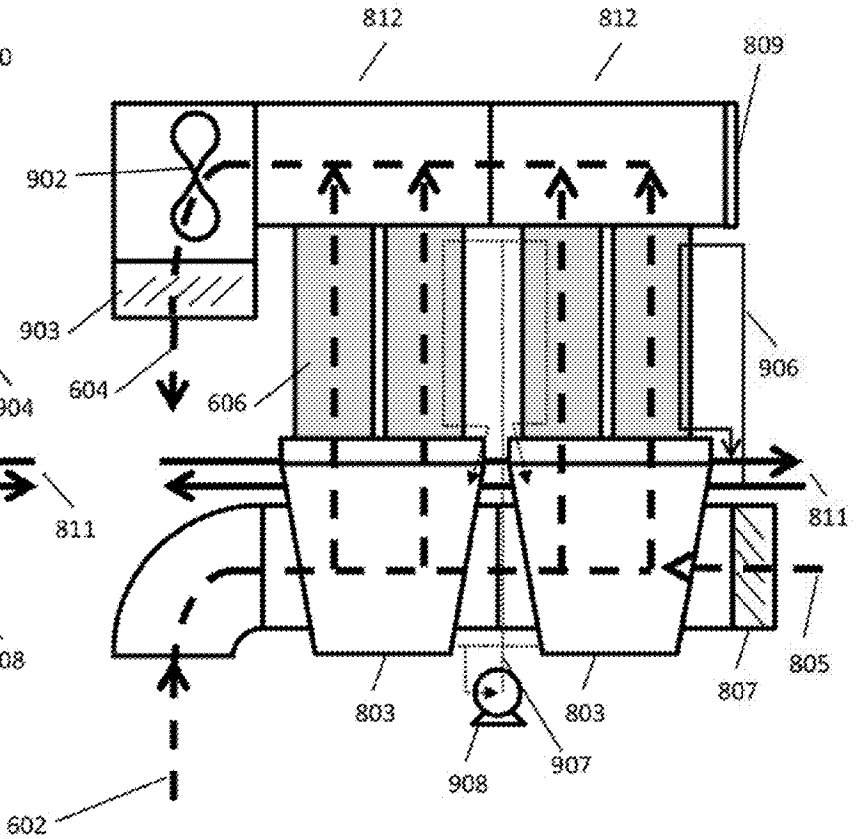
FIG. 9B shows a schematic diagram of the regenerator side of the system of FIG. 8.
Figure 9A:
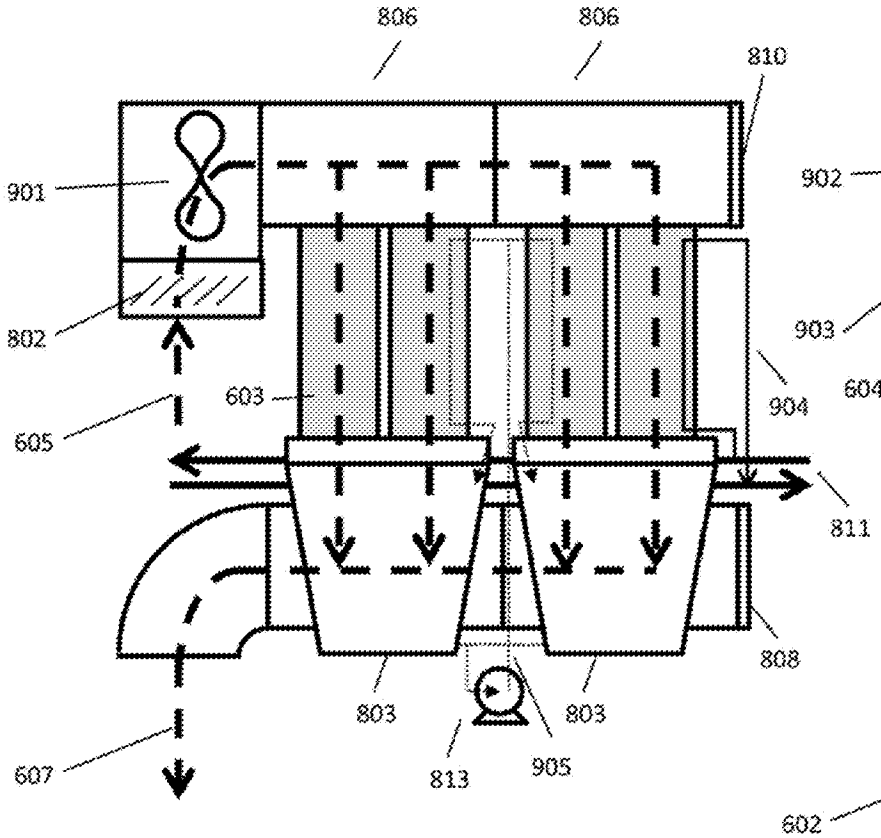
FIG. 9A shows a schematic diagram of the conditioner side of the system of FIG. 8.
Figure 10:
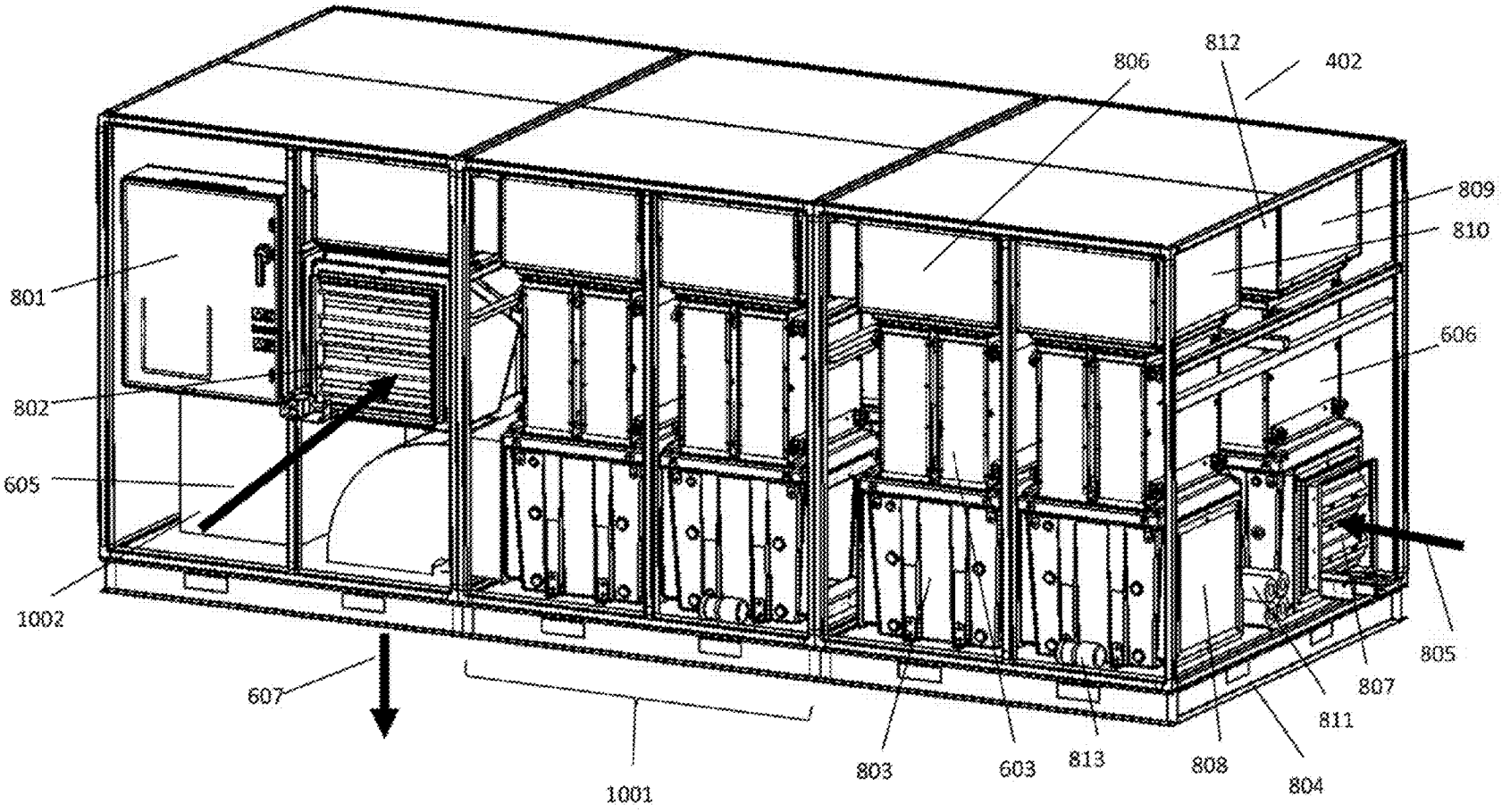
FIG. 10 shows how the system of FIG. 8 can be expanded to increase the system's air flow and cooling capacity.

FIG. 9A illustrates the conditioner side of the system of FIG. 8. As mentioned before, outside air 605 enters the system through louvers 802. Fan 901 brings the air through ducts 806. Conditioner membrane modules 603 cool and dehumidify the air stream which is transported through tubs 803 into the supply air stream 607. End plates 808 and 810 terminate the system. Water lines for cold water supply and return 811 bring cold water to the individual conditioner modules 603. For clarity only one of the water lines 904 is shown, the other modules 603 receive cooling water in a similar fashion. The desiccant pump 813 receives liquid desiccant from the tub modules 803. The pump distributes the liquid desiccant to the conditioner modules 603 through supply lines 905. For clarity the desiccant supply lines for two of the conditioner modules are shown in the figure and the remainder has been omitted. As can be seen in the figure, the desiccant drains out of the conditioner modules back into the tub modules 803.

FIG. 9B shows—similarly to FIG. 9A—the main components of the regenerator side of the system of FIG. 8. Return air 602 from the building is directed through the tub modules 803 and through the regenerator modules 606. The regenerator ducts 812 conduct the air streams back through fan 902 and louver 903 where the hot, humid air 604 is exhausted. Since in buildings the amount of available return air can be less than the amount of air that is supplied to the building (supply air 607 is larger than return air 602) and additional outside air stream 805 can be mixed in through louver 807. This helps to ensure that the system has adequate air supply for the regenerator modules. Similar to the conditioner side, desiccant pump 908 provides liquid desiccant to the regenerator modules 606 through supply lines 907. Hot water 906 is also supplied to the regenerator modules. For clarity only some of the water and desiccant lines have been shown.

It is also possible to reverse the direction of the chiller 609 in a winter operating mode so that the conditioner 603 receives hot heat transfer fluid and the regenerator 606 receives cold heat transfer fluid. In this mode the conditioner will desorb water vapor and humidify and heat the supply air stream 607 and the regenerator will absorb heat and water vapor from the return air stream 602 from the space. In effect the system will recover heat and moisture from the return air stream 602 in this mode.

FIG. 10 show the system of FIG. 8 with an additional section 1001 comprising 4 conditioner and 4 regenerator modules have been inserted in the system of FIG. 8. The chiller 1002 as well as the fans and water pumps (not shown) now need to be sized to accommodate for the increase in air flow and cooling load of the system. It will be apparent that one can continue to increase the air flow and cooling capacity of the system by continuing to add membrane models and other components, at least until the air flow capacity of the ducts and tubs is exceeded.

Figure 11:
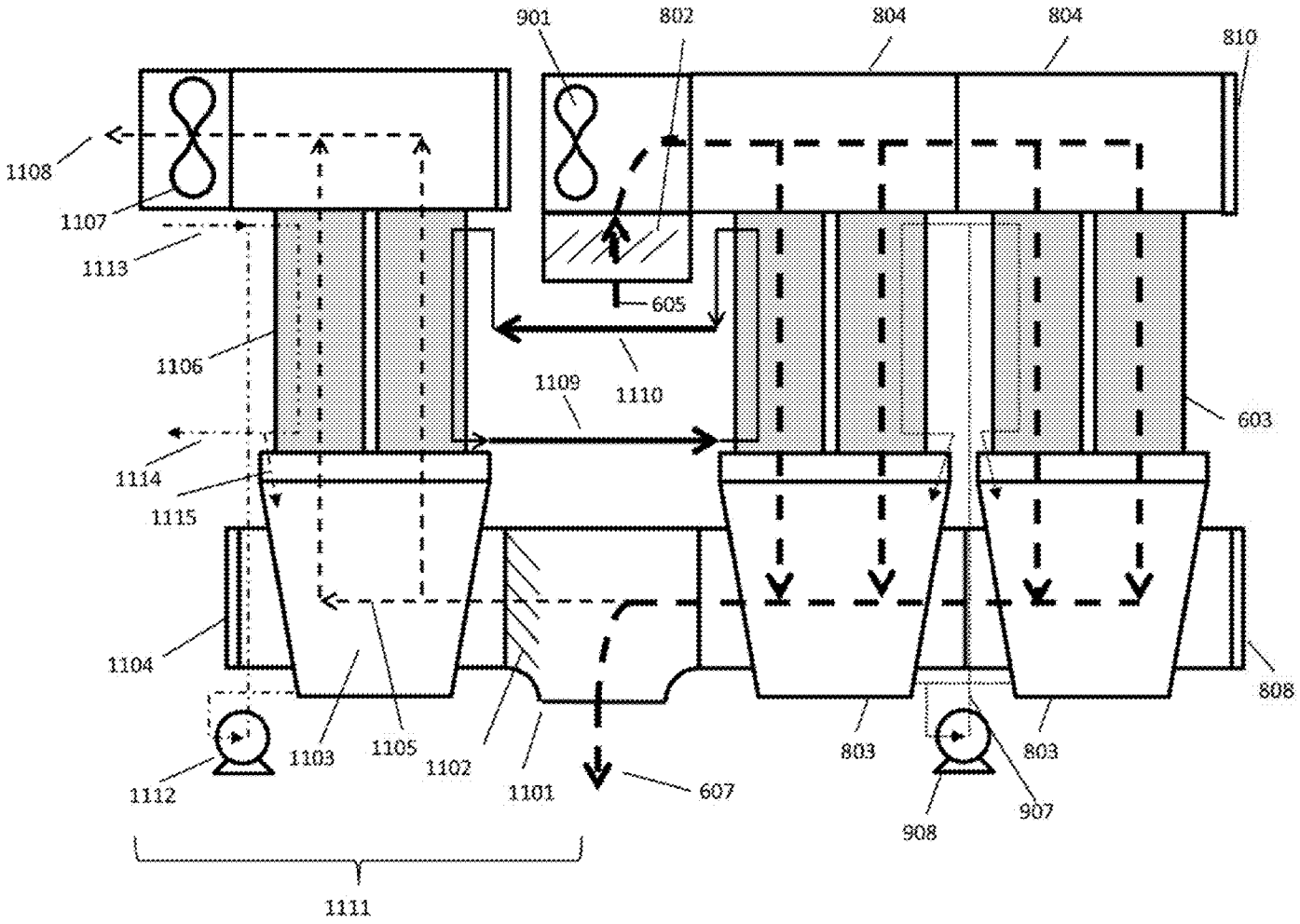
FIG. 11 shows an alternate embodiment of the system of FIG. 8 wherein the chiller has been replaced by an indirect evaporative cooling system.

FIG. 11 shows a schematic diagram of an alternate embodiment of the linkable system of FIG. 6. The chiller section 609 from FIG. 6 and FIG. 8 has now been omitted in favor of an indirect evaporative cooling section 1111. The supply air 607 is partially diverted (typically between 0 and 30%) as air stream 1105 into duct 1101 and louver 1102 to enter tub 1103. The air stream now moves upward through membrane modules 1106. But unlike the conditioner modules and regenerator modules, these evaporator membrane modules have water rather than desiccant behind their membranes. Since the air stream 1105 is very dry, a large cooling effect can be obtained in the membrane modules 1106 by evaporating the water behind the membranes. This in turn results in the heat transfer fluid 1109 becoming substantially cooled. This cold heat transfer fluid 1109 can then be used to remove heat from the original membrane modules 603. The warmer heat transfer fluid 1110 is circulating back to the indirect evaporative cooling section 1111 from the conditioner modules 603. Since the evaporator modules 1106 evaporate water, there needs to be a constant supply of water 1113. This water can be clean drinking water, in which case the membranes on the evaporator modules 1106 are not absolutely necessary. In that case also, the remaining water can be drained 1115 from the membrane modules 1106 into the tub 1103 and removed from the tub by pump 1112 to be re-used at the top of the evaporative modules 1106. Attention has to be paid to ensure that like a conventional cooling tower, there is no buildup of scale and other contaminants. There are several methods common in the industry that can be employed to deal with scale issues, for example blow-down systems or ultrasonic precipitation.

However, the use of membrane in evaporator modules 1106 also enables the use of seawater or waste water: the membranes will contain any salt particles or other contamination. In this case, the intent is to evaporate only a portion (typically around 50% or less) of the water supplied by supply 1113. The concentrated remaining water is then drained through line 1114 and disposed of in an appropriate drainage system. The pump 1112 can now be omitted and no scaling or blow-down system is required. However membrane fouling may become an issue and can be dealt with using flushing and a proper pre-filtration system. The exhaust air stream 1108 leaving the evaporator modules 1106 is warm and near saturation and is pulled through the system by fan 1107. It should be clear from the figure that when one adds additional conditioner modules 603 there should also be additional evaporator modules 1106. This can be easily accomplished by removing cover 1104 and adding an additional section 1111. Fan 1107 would also have to be sized larger and moved to the added section.

It is also possible to reverse the air stream 1105 while at the same time providing hot heat transfer fluid to the conditioner blocks 603. In this winter heating mode, the conditioner will desorb water vapor into the air stream 1105 and the conditioners 603 will combine to supply warm, moist air to the space 607.

Figure 12:
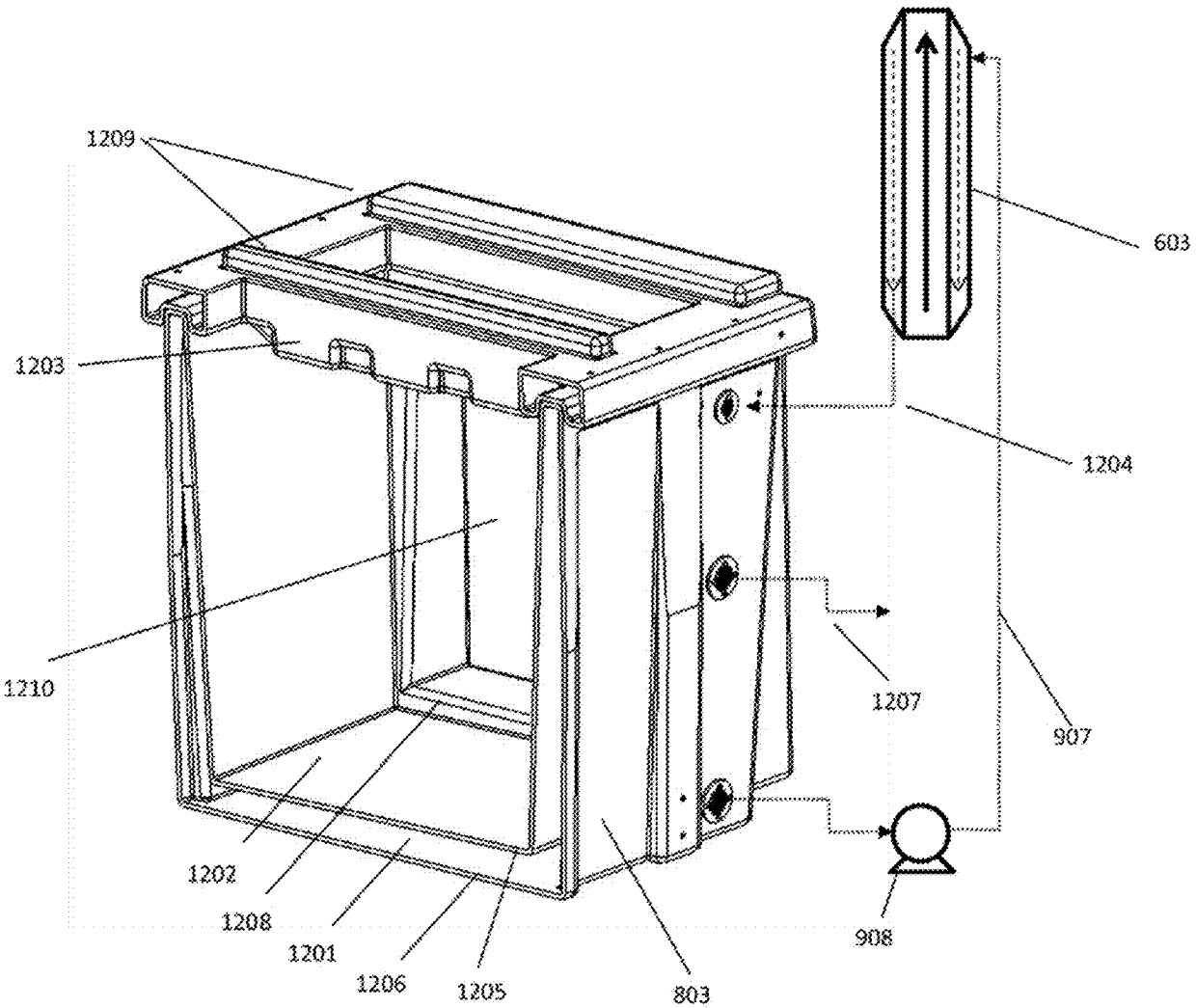
FIG. 12 shows a detail of the membrane mass and heat exchanger tub support structure of FIG. 8.

FIG. 12 illustrates a detail cross section of the membrane module support tub 803 and part of the desiccant distribution system connected to it. The tub 803 is constructed as a hollow shell structure with walls 1205 and 1206. The inner area 1201 functions as a liquid desiccant storage tank. This is beneficial since it eliminates the need for a separate tank and since the volume is located directly below the membrane modules, syphoning of desiccant into the tank structure is enhanced. Furthermore the tank structure allows for stratification of the desiccant wherein the higher concentration of desiccant can be found near the bottom of the tub and the lower concentration can be found near the top. The inner bottom 1202 of the tub 803 is slowed in such a way that any leaks from the membrane modules above will drain into a single corner where a detector or sensor can be located to indicate that a leak has occurred. Furthermore bottom has a lip 1208 constructed in such a way that the air stream cannot transport any droplets that may fall from the membrane modules. The membrane modules physically sit on the support plate 1203 which has designed in rail features 1209 to allow for a tight air seal between the membrane modules and the tub structure. Since the tub 803 contains the desiccant for the system, pump 908 pulls desiccant from the lower port on the tub, pumps it to the top of the membrane module 603 wherefrom it drains by gravity back through drain 1204 into the top port of the tub. A secondary port 1207 allows for dilute desiccant to be removed and pumped to the regenerator modules which are set up in a similar fashion except that the regenerator pumps from the top port to the top of membrane modules 606 and removes concentrated desiccant from the bottom port back to the conditioner. The air duct 1210 can also be seen in the figure.

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Additionally, elements and components described herein may be further divided into additional components or joined together to form fewer components for performing the same functions. Accordingly, the foregoing description and attached drawings are by way of example only, and are not intended to be limiting.

The invention claimed is:

1. A method for increasing energy efficiency of an air conditioning system for a building, said air conditioning system comprising a plurality of existing air conditioning units mounted on a rooftop of the building, the method comprising:

(a) removing some, but not all, of the plurality of air conditioning units from the rooftop;

(b) installing a liquid desiccant air-conditioning unit on the rooftop in place of each removed air conditioning unit, said liquid desiccant air-conditioning unit being switchable between operating in a warm weather operation mode and in a cold weather operation mode, each liquid desiccant air-conditioning unit comprising:

a conditioner configured to expose a ventilation air stream entering the building from outside the building to a liquid desiccant such that the liquid desiccant dehumidifies the ventilation air stream in the warm weather operation mode and humidifies the ventilation air stream in the cold weather operation mode; and a regenerator connected to the conditioner and configured to expose an air stream to the liquid desiccant such that the liquid desiccant humidifies the air stream in the warm weather operation mode and dehumidifies the air stream in the cold weather operation mode; and (c) completely transferring a ventilation air stream treatment load from the one or more air conditioning units remaining on the rooftop to each liquid desiccant air-conditioning unit by reconfiguring the one or more air conditioning units remaining on the rooftop such that any intake of a ventilation air stream for the building in said one or more air conditioning units is eliminated by removing power to a damper motor of the one or more air-conditioning units remaining on the rooftop or removing a lever from a damper mechanism of the one or more air-conditioning units remaining on the rooftop.

2. The method of claim 1, wherein the conditioner includes a plurality of structures arranged in a vertical orientation, each structure having at least one surface across which the liquid desiccant can flow, wherein the ventilation air stream flows between the structures, and wherein the regenerator includes a plurality of structures arranged in a vertical orientation, each structure having at least one surface across which the liquid desiccant can flow, wherein a return air stream flows between the structures.

3. The method of claim 2, wherein each of the plurality of structures in the regenerator and conditioner includes an internal passage through which a heat transfer fluid can flow for transfer of heat between the heat transfer fluid and the liquid desiccant or the ventilation air stream or the return air stream.

4. The method of claim 3, wherein each of the plurality of structures in the regenerator and conditioner includes a sheet of material positioned proximate to the outer surface of each structure between the liquid desiccant and an air stream, said sheet of material permitting transfer of water vapor between the liquid desiccant and the ventilation air stream or the return air stream.

5. The method of claim 4, wherein the sheet of material comprises a membrane.

6. The method of claim 2, wherein said plurality of structures in the regenerator and conditioner comprise a plurality of plate assemblies arranged in a vertical orientation and spaced apart to permit flow of the air stream between adjacent plate assemblies.

7. The method of claim 1, wherein the ventilation air stream entering the building flows in a vertical direction through the conditioner and the air stream flowing in the regenerator flows in a vertical direction.

8. The method of claim 1, wherein the ventilation air stream entering the building flows in a generally horizontal direction through the conditioner and the air stream flowing in the regenerator flows in a generally horizontal direction.

9. The method of claim 1, wherein each liquid desiccant air-conditioning unit further comprises a heat pump for pumping heat from the conditioner to the regenerator in the warm weather operation mode and pumping heat from the regenerator to the conditioner in the cold weather operation mode.

10. The method of claim 9, wherein the heat pump pumps heat from the liquid desiccant flowing in the conditioner to the liquid desiccant flowing in the regenerator in the warm weather operation mode, and wherein the heat pump pumps heat from the liquid desiccant flowing in the regenerator to the liquid desiccant flowing in the conditioner in the cold weather operation mode.

11. The method of claim 9, wherein the heat pump pumps heat from a heat transfer fluid flowing in the conditioner to a heat transfer fluid flowing in the regenerator in the warm weather operation mode, and wherein the heat pump pumps heat from the heat transfer fluid flowing in the regenerator to the heat transfer fluid flowing in the conditioner in the cold weather operation mode.

12. The method of claim 1, wherein each liquid desiccant air-conditioning unit further comprises a heat exchanger connected between the conditioner and the regenerator for transferring heat from the liquid desiccant flowing from one of the regenerator and the conditioner to the liquid desiccant flowing from the other of the regenerator and conditioner.

13. The method of claim 1, wherein every one out of three to one out of five of the removed air conditioning units is replaced by a liquid desiccant air-conditioning unit.

14. The method of claim 1, wherein reconfiguring the one or more air conditioning units comprises recirculating a return air stream from the building through a coil of an evaporator of each of said one or more air conditioning units, and increasing the operating temperature of the evaporator.

15. The method of claim 1, reconfiguring the one or more air conditioning units remaining on the rooftop comprises closing a damper therein to reduce or eliminate intake of a ventilation air stream.

16. The method of claim 1, wherein step (c) further comprises changing an evaporator temperature setting of the one or more air conditioning units remaining on the rooftop to a higher temperature setting.

17. The method of claim 16, wherein the higher temperature setting increases the evaporator temperature such that substantially no condensation forms on the evaporator.

18. The method of claim 16, wherein the higher temperature setting is 50-60° F.

* * * * *